US005169514A

United States Patent [19]

Hendriks et al.

[11] Patent Number: 5,169,514

[45] Date of Patent: Dec. 8, 1992

[54] PLATING COMPOSITIONS AND PROCESSES

[75] Inventors: Jan J. M. Hendriks, Oedenrode; Gerard A. Somers, Schayk; Henrica M. H. van der Steen, Berlicum, all of Netherlands

[73] Assignee: Enthone-OMI, Inc., West Haven, Conn.

[21] Appl. No.: 656,336

[22] Filed: Feb. 19, 1991

[30] Foreign Application Priority Data

Feb. 20, 1990 [GB] United Kingdom ..... 9003762

[51] Int. Cl.[5] ..... C25D 3/48; C25D 3/62; C23C 16/06

[52] U.S. Cl. ..... 205/247; 205/250; 205/267; 106/118; 427/437; 427/443.1

[58] Field of Search ..... 204/47.5, 44.3, 44.5, 204/43.1; 205/250, 247, 267; 427/437, 443.1; 106/1.18

[56] References Cited

U.S. PATENT DOCUMENTS 3,929,595 12/1975 Biberbach et al. ..... 204/44.3
5,024,736 6/1991 Clauss et al. ..... 204/49
5,049,286 9/1991 Tremmel ..... 204/49

FOREIGN PATENT DOCUMENTS 150439 8/1985 European Pat. Off. ..... 204/44.3
188386 7/1986 European Pat. Off. ..... 204/44.3

*Primary Examiner*—John Niebling
*Assistant Examiner*—Brian M. Bolam
*Attorney, Agent, or Firm*—Richard P. Mueller

[57] ABSTRACT

A gold or gold alloy plating composition comprises: a source of gold ions such as potassium gold (I) cyanide; optionally a source of alloying metal (e.g. nickel or cobalt) ions, for example as a sulphate; optionally a complexing agent for the alloying metal ions if present, such as citic acid or oxalic acid; and a rate promoting additive compound of general formula IA or IB:

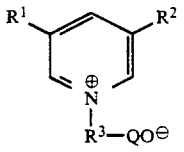

(IA)

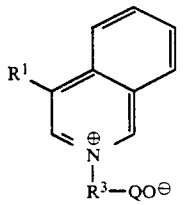

(IB)

wherein:

each of $R^1$ and $R^2$ independently represents a hydrogen or halogen atom or a formyl, carbamoyl, $C_{1-4}$ alkyl, amino, phenyl or benzyl group, wherein the alkyl, phenyl and benzyl moieties may optionally be substituted with one or more hydroxy or amino groups or halogen atoms;

$R^3$ represents a $C_{1-6}$ alkylene radical which may optionally be hydroxylated; and Q represents $—SO_2—$ or —CO—.

The rate promoter extends the plating current density range of the composition, particularly by reducing or preventing burn at high current densities, and gives a net increase in achievable plating speed for bright deposition.

18 Claims, No Drawings

PLATING COMPOSITIONS AND PROCESSES

This invention relates to gold or gold alloy plating compositions and processes as well as articles plated thereby. In particular, the invention relates to gold or gold alloy plating compositions containing one or more additives which function as rate promoters. Rate promoters are desirable to extend the plating current density range of the composition, particularly by reducing or preventing burn at high current densities, and to give a net increase in achievable plating speed for bright deposition.

Gold is electroplated for a variety of functional and decorative uses, and the hardness of the plate can be increased by incorporating a base metal alloy metal in the deposit. Typical alloying metals include cobalt, nickel, iron and sodium. Certain rate promoters are known in gold alloy plating compositions, as is apparent from the following few paragraphs.

U.S. Pat. No. 4,069,113 discloses gold alloy electroplating baths containing aluminium ions and formic acid as rate promoting additives.

U.S. Pat. No. 4,615,774 discloses gold alloy electroplating compositions in which higher plating speeds are obtained by avoiding the use of citrates.

U.S. Pat. No. 4,670,107 discloses gold alloy electroplating compositions said to achieve rapid plating speeds and including formic acid and a phosphonic acid chelating agent.

U.S. Pat. No. 4,744,871 discloses gold alloy plating compositions containing combinations of certain low molecular weight monocarboxylic and dicarboxylic acids, which are said to permit the use of high current densities.

EP-A-0150439 discloses gold alloy electroplating baths containing rate promoters which are substituted pyridine compounds, particularly pyridine carboxylic acids, pyridine sulphonic acids, pyridine thiols and their derivatives, or quinoline derivatives.

U.S. Pat. No. 3,929,595 discloses pyridine-3-sulphonic acids, picoline sulphonic acids and quinoline sulphonic acids as additives for gold and gold alloy electroplating baths.

EP-A-0188386 discloses gold alloy electroplating baths including rate promoting additives which are pyridine or piperazine derivatives and which are favourably compared to pyridine-3-sulphonic acid.

The current invention seeks to provide gold or gold alloy plating compositions containing effective rate promoters which are distinct from and an improvement on those previously proposed. It has been discovered that excellent rate promotion can be had by incorporation into gold alloy plating compositions one or more pyridine or isoquinoline betaines, which give favourable results when compared to, for example, pyridine-3-sulphonic acid.

According to a first aspect of the present invention, there is provided a gold or gold alloy plating composition comprising: a source of gold ions; optionally a source of alloying metal ions; optionally a complexing agent for the alloying metal ions if present; and at least one additive compound of general formula IA or IB:

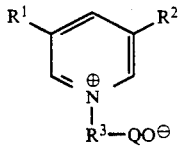

(IA)

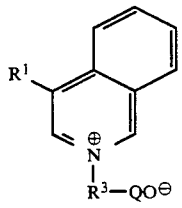

(IB)

wherein:

each of $R^1$ and $R^2$ independently represents a hydrogen or halogen atom or a formyl, carbamoyl, $C_{1-4}$ alkyl, amino, phenyl or benzyl group, wherein the alkyl, phenyl and benzyl moieties may optionally be substituted with one or more hydroxy or amino groups or halogen atoms;

$R^3$ represents a $C_{1-6}$ alkylene radical which may optionally be hydroxylated; and Q represents $—SO_2—$ or —CO—.

The source of gold ions will generally be bath soluble and is preferably a gold (I) salt, which could for example be an alkali metal gold (I) cyanide or ammonium gold (I) cyanide. The gold may be present in an amount of from 1 to 30 g/l, preferably from 2 to 20 g/l, for example from 4 to 12 g/l.

The alloying metal ions if present may be any suitable alloy metal. Alloying metal ions typically used include nickel, cobalt and iron, although iron is less preferred because it has a tendency to give brittle deposits. Nickel is the most preferred alloying metal, as the improvements seen by virtue of the additives of the invention are particularly notable. The source of alloying metal ions will generally be bath soluble and can comprise any bath soluble and compatible salt of the alloying metal. Sulphates are particularly suitable salts and are preferred. The alloying metal may be present in an amount of from 0 to 20 g/l, preferably from 0.05 or 0.5 to 5 g/l, for example from 1 to 3 g/l.

Gold alloy plating compositions in accordance with the invention can comprise one or more complexing agents for the alloying metal ions. The nature of the complexing agent is not believed to be critical, and so any suitable complexing agent in appropriate amounts can be used. Weak organic acids such as citrate and oxalate may be used, as may DEQUEST compositions. (The word DEQUEST is a trade mark). If one or more weak organic acids are used as complexing agents, as is preferred, they can also serve the additional function of buffering the aqueous plating composition. Therefore, compounds which would have the capability of complexing an alloying metal ion may be present in a pure gold plating bath in which no appreciable amount of alloying ions are present. It is to be understood that throughout this specification reference to a weak organic acid and its anion are used interchangeably; the nature of the species present will depend on the pH of the bath. Citric acid is a useful complexing agent, as is oxalic acid, which can be used in conjunction with malic acid. The concentration of the complexing agent may range from 0.1M to 2M, for example 0.2M to 1.5M, typically from 0.5M to 1.1M.

The additive compound is a pyridine betaine or isoquinoline betaine of general formula IA to IB, as given above. It is preferred for at least one of the substituents $R^1$ and $R^2$ in general formula IA (the pyridine betaines) to be hydrogen and for the substituent $R^1$ in general formula IB (the isoquinoline betaines) to be hydrogen. In general formula IA, at least one of $R^1$ and $R^2$ may be carbamoyl or, preferably, formyl.

$R^3$ preferably represents a $C_{1-4}$ alkylene moiety, such, as ethylene or propylene. The alkylene moiety can be hydroxylated; for example 2-hydroxy propylene radical is particularly preferred.

It is preferred that Q represents $SO_2$, so that the additive compounds are betaine sulphonates rather than betaine carboxylates. Among the most preferred compounds are:

1-(3-sulphopropyl)-pyridinium betaine;
1-(2-hydroxy-3-sulphopropyl)-pyridinium betaine;
3-formyl-1-(3-sulphopropyl)-pyridinium betaine;
3-carbamoyl-1-(3-sulphopropyl)pyridinium betaine;
1-(2-sulphoethyl)-pyridinium betaine; and
1-(3-sulphopropyl)-isoquinolinium betaine, all of which are available commercially.

The additive compound may be present in compositions of the invention in an amount of from 0.05 or 0.1 to 10 g/l, typically 0.5 to 5 g/l, for example 1 to 3 g/l.

A pH adjusting agent, for example potassium hydroxide or another alkali metal hydroxide, may be present in the bath, preferably in an amount which will provide a final bath pH of from 3.2 to 5.5, more particularly from 3.9 to 4.9. As mentioned above, a buffering system may be present to assist in the stabilisation of the pH, and a citric acid/alkaline metal citrate system works efficiently in this respect. Any other appropriate buffering system may be present if desired.

Although it is not necessary for the bath to contain any further ingredients, other additives may be used to modify and/or further improve brightness, ductility, grain refinement and the like. Components for these and other purposes, as may be conventional in the art, may be added in accordance with known practice. In doing so, however, the components added should be compatible with the other bath components and not have any adverse effects on the bath or its operation.

According to a second aspect of the invention, there is provided a process for electrodepositing a gold or gold alloy plate on a substrate, the process comprising contacting a substrate as a cathode in an aqueous composition in accordance with the first aspect and passing current between the cathode and an anode in the composition.

The composition may be operated at a temperature of from 20° C. to 80° C., preferably from 30° to 70° C., for example from 35° to 60° C., during plating.

The substrate may be contacted with the composition in any convenient manner. It will usually be most convenient to immerse the substrate in a bath of the aqueous composition, but this is not the only way in which contact between the composition and the substrate can be achieved; for example, spray plating or brush plating may be appropriate or desirable in some circumstances.

Whatever the method of contact between the composition and the substrate, it is generally preferred to cause the composition to be agitated so as to cause turbulence in a plating bath. Agitation may be achieved by any convenient means, and will usually be dictated by the particular plating method used. The invention can be used in barrel plating, rack plating, controlled immersion plating and jet plating, and each plating method has its own means for achieving agitation.

The additives used in compositions of the present invention enables higher current densities to be used, or a lower concentration of gold to be used or a combination of these two advantages. If maximising current density is the main objective, barrel plating may take place at 0.6 ASD or more, rack plating at 2 or 3 ASD or more, controlled immersion plating at 15 ASD or more and jet plating at 100 ASD or more.

The plating time will be such as to achieve the desired thickness of plate and will clearly be related to the plating speed. The plating speed in turn will depend on the current density. Plating speeds in the order of 10 to 20 μm/min are readily achievable by means of the present invention. Contact times between the substrate and the plating composition may therefore vary from a few seconds (for example 2 or 5 seconds) to several minutes (for example from 5 to 10 minutes or more). After plating the duly plated substrate is preferably rinsed in softened or deionised water, particularly when oxalate is used in the composition, so as to avoid unwanted deposits of calcium oxalate or other salts.

According to a third aspect of the present invention, there is provided a substrate which has been plated by means of a composition and/or following a process as described above. The thickness of the gold or gold alloy plate on the substrate may be at least 1 μm. It should be noted that the present invention also has application to electroforming, and so the original substrate may be removed after a suitable thickness of plate has been built up. Plating may continue after removal of the forming substrate.

Other preferred features of the second and third aspects are as for the first aspect mutatis mutandis.

For a better understanding of the invention, the following non-limiting examples are given and are to be contrasted with the comparison examples.

COMPARISON EXAMPLE 1

A bath having the following composition was made up:

| | |
|---|---|
| DL-Malic acid | 95 g/l |
| Oxalic acid | 37.0 g/l |
| Gold (as gold (I) potassium cyanide) | 8 g/l |
| Nickel (as nickel sulphate) | 1.0 g/l |
| Potassium hydroxide | to pH 4.2 |
| Distilled water | to 1 litre |

The bath formulated as above was placed in a laboratory scale turbulent agitation plating system. Electrolyte was pumped through two pipes into a one liter beaker and was directed through holes in the pipes onto the substrate, which was immersed as the cathode in the beaker. Electrolyte solution was pumped away through a third pipe in the beaker. The cathode is located between the two supply pipes and anodes are placed around the supply pipe at such a position that they do not disturb the solution flow.

The solution is heated to and kept at a temperature of 45° C. and pumped around the system at a flow rate of 2 l/min (which flow rate is measured with water at room temperature).

This bath operated at an ultimate acceptable current density of 4 ASD. A fully bright 1.5 μm deposit was achieved at a plating speed of 1.5 μm/min. The plating efficiency was 65 mg/A.min. For comparison purposes, an acceptability rating of 0 was assigned to the bath. The acceptability rating is primarily based on plating efficiency and the ability to withstand burn at high current density areas.

EXAMPLE 1

The procedure of Comparative Example 1 was repeated, but with the addition of 2.0 g of 1-(3-sulphopropyl)-pyridinium betaine, (available from Raschig GmbH, Ludwigshafen, Germany) in the plating composition. The current density used in this bath was 15 ASD at which fully bright deposits of 1.5 μm were achieved with a plating speed of 2.7 μm/min, representing a significant advancement over Comparative Example 1. The plating efficiency was 31 mg/A.min. At 4 ASD the speed was 1.3 μm/min, which represents a plating efficiency of 55 mg/A.min. The bath was awarded an acceptability rating of 10.

EXAMPLE 2

The procedure of Comparative Example 1 was repeated, but with the addition of 1.5 g/l of 1-(3-sulphopropyl)-isoquinolinium betaine (Raschig) in the plating composition. The maximum current density usable in this bath was 10 ASD at which fully bright deposits of 1.5 μm were achieved at a maximum plating speed of 2.0 μm/min. The plating efficiency was 33 mg/A.min. The bath was awarded an acceptability rating of 8.

EXAMPLE 3

The procedure of Comparative Example 1 was repeated, but with the addition of 2 g/l of 3-formyl-1-(3-sulphopropyl) pyridinium betaine (Raschig) is the plating composition. The maximum current density usable in this bath was 15 ASD at which fully bright deposits of 1.5 μm were achieved at a maximum plating speed of 2.0 μm/min. The plating efficiency was 23 mg/A.min. The bath was awarded an acceptability rating of 8.

EXAMPLE 4

The procedure of Comparative Example 1 was repeated, but with the addition of 2 g/l of 1-(2-hydroxy-3-sulphopropyl) pyridinium betaine (Raschig) in the plating composition. The maximum current density usable in this bath was 11 ASD at which fully bright deposits of 1.5 μm were achieved at a maximum plating speed of 2.5 μm/min. The plating efficiency was 37 mg/A.min. The bath was awarded an acceptability rating of 9.

EXAMPLE 5

The procedure of Comparative Example 1 was repeated, but with the addition of 1 g/l of 1-(2-sulphoethyl) pyridinium betaine (BASF) in the plating composition. The maximum current density usable in this bath was 12 ASD at which fully bright deposits of 1.5 μm were achieved at a maximum plating speed of 2.3 μm/min. The plating efficiency was 33 mg/A.min. The bath was awarded an acceptability rating of 9.

COMPARATIVE EXAMPLE 2

The procedure of Comparative Example 1 was repeated, but with the addition of 1 g/l of pyridine-3-sulphonic acid (as in U.S. Pat. No. 3,929,595) in the plating composition. The maximum current density usable in this bath was only 7 ASD at which fully bright deposits of 1.5 μm were achieved at a maximum plating speed of 2.1 μm/min. The plating efficiency was 52 mg/A.min. The bath was awarded an acceptability rating of 6.

COMPARATIVE EXAMPLE 3

The procedure of Comparative Example 1 was repeated, but with the addition of 1 g/l of pyridine-4-ethanesulphonic acid in the plating composition. The maximum current density usable in this bath was only 7 ASD at which fully bright deposits of 1.5 μm were achieved at a maximum plating speed of 2.0 μm/min. The plating efficiency was 50 mg/A.min. The bath was awarded an acceptability rating of 6.

COMPARATIVE EXAMPLE 4

A bath having the following composition was made up.

| | |
|---|---|
| Potassium citrate | 50 g/l |
| Citric acid | 70 g/l |
| Potassium oxalate | 50 g/l |
| Nickel (as nickel sulphate) | 1 g/l |
| Gold (as potassium gold (I) cyanide) | 8 g/l |
| Potassium hydroxide | to pH 4.2 |
| Distilled water | to 1 litre |

A substrate was plated under the same conditions as described in Comparative Example 1. The maximum current density used in this bath was 4 ASD, at which burnt deposits of 1.5 μm were achieved at a plating speed of 1.8 μm/min. The plating efficiency was 80 mg/A.min. The bath was awarded an acceptability rating of 0.

EXAMPLE 6

The procedure of Comparative Example 4 was repeated, but with the addition of 7 g/l 1-(3-sulphopropyl)-pyridinium betaine (Raschig) in the plating composition. The maximum current density usable in this bath was 10 ASD, at which fully bright deposits of 1.5 μm were achieved at a maximum plating speed of 2.3 μm/min. The plating efficiency was 40 mg/A.min. The bath was awarded an acceptability rating of 9.

COMPARATIVE EXAMPLE 5

A bath having the following composition was made up:

| | |
|---|---|
| Citric acid | 110 g/l |
| Potassium citrate | 90 g/l |
| DEQUEST 2010 | 50 ml/l |
| Cobalt (as cobalt sulphate) | 1 g/l |
| Gold (as potassium gold (I) cyanide) | 8 g/l |
| Potassium hydroxide | to pH 4.0 |

A substrate was plated under the same conditions as described in Comparative Example 1. The maximum current density used in this bath was 8 ASD, at which acceptable deposits of 1.5 μm were achieved at a maximum plating speed of 2.3 μm/min. The plating efficiency was 50 mg/A.min. The bath was awarded an acceptability rating of 6.

EXAMPLE 7

The procedure of Comparative Example 5 was repeated but with the addition of 1 g/l 1-(3-sulphopropyl)-pyridinium betaine (Raschig) in the plating composition. The maximum current density usable in this bath was 13 ASD, at which fully bright deposits of 1.5 μm were achieved at a maximum plating speed of 3.0 μm/min. the plating efficiency was 41 mg/A.min. The bath was awarded an acceptability rating of 10.

We claim:

1. A gold or gold alloy plating composition comprising: a source of gold ions; optionally a source of alloying metal ions; optionally a complexing agent for the alloying metal ions if present; and at least one additive compound of general formula IA or IB:

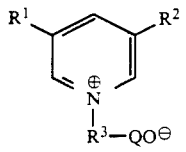

(IA)

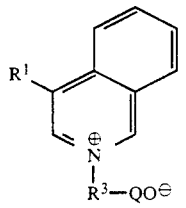

(IB)

wherein:

each of $R^1$ and $R^2$ independently represents a hydrogen or halogen atom or a formyl, carbamoyl, $C_{1-4}$ alkyl, amino, phenyl or benzyl group, wherein the alkyl, phenyl and benzyl moieties may optionally be substituted with one or more hydroxy or amino groups or halogen atoms;

$R^3$ represents a $C_{1-6}$ alkylene radical which may optionally be hydroxylated; and Q represents $—SO_2—$ or —CO—.

2. A composition as claimed in claim 1, wherein the source of gold ions is a gold (I) salt.

3. A composition as claimed in claim 1, wherein the gold is present in an amount of from 2 to 20 g/l.

4. A composition as claimed in claim 1, wherein the alloying metal ions comprise nickel, cobalt and/or iron.

5. A composition as claimed in claim 1, wherein the alloying metal ions comprise nickel.

6. A composition as claimed in claim 4, wherein the source of alloying metal ions comprises a sulphate of the alloying metal.

7. A composition as claimed in claim 4, wherein the alloying metal may be present in an amount of from 0.05 to 5 g/l.

8. A composition as claimed in claim 1, wherein the complexing agent comprises citric acid or oxalic acid.

9. A composition as claimed in claim 1 wherein the additive agent is present in any amount of from 0.05 to 10 g/l.

10. A composition as claimed in claim 1, wherein in general formula IA at least one of the substituents $R^1$ and $R^2$ is hydrogen.

11. A composition as claimed in claim 1, wherein in general formula IA at least one of the substituents $R^1$ and $R^2$ is carbamoyl or formyl.

12. A composition as claimed in claim 1, wherein in general formula IB the substituent $R^1$ is hydrogen.

13. A composition as claimed in claim 1, wherein $R^3$ represents an ethylene or propylene radical.

14. A composition as claimed in claim 1, wherein Q represents $SO_2$.

15. A composition as claimed in claim 1 wherein the additive compound is one or more of:

1-(3-sulphopropyl)-pyridinium betaine;
1-(2-hydroxy-3-sulphopropyl)-pyridinium betaine;
3-formyl-1-(3-sulphopropyl)-pyridinium betaine;
3-carbamoyl-1-1-(3-sulphopropyl)pyridinium betaine;
1-(2-sulphoethyl)-pyridinium betaine; and
1-(3-sulphopropyl)-isoquinolinium betaine.

16. A composition as claimed in claim 1, having a pH of from 3.9 to 4.9.

17. A process for electrodepositing a gold or gold alloy plate on a substrate, the process comprising contacting a substrate as a cathode in an aqueous composition as claimed in claim 1 and passing current between the cathode and an anode in the composition.

18. A process as claimed in claim 17, which is operated at from 30 degrees to 70 degrees C during plating.

* * * * *